United States Patent [19]

Lightner

[11] Patent Number: 4,478,118

[45] Date of Patent: Oct. 23, 1984

[54] METHOD FOR RECOVERING THE CONTENTS OF FILLED PHARMACEUTICAL CAPSULES

[75] Inventor: Roy W. Lightner, Kansas City, Mo.

[73] Assignee: Marion Laboratories, Inc., Kansas City, Mo.

[21] Appl. No.: 352,158

[22] Filed: Feb. 25, 1982

[51] Int. Cl.[3] ..... B26D 3/16; B26D 7/06

[52] U.S. Cl. ..... 83/24; 83/54; 83/99; 83/409.2; 83/411 R; 414/412

[58] Field of Search ..... 83/24, 54, 98–100, 83/409.1, 409.2, 411 R, 267, 733; 414/412; 241/DIG. 27; 209/3; 53/492, 381 R; 30/2

[56] References Cited

U.S. PATENT DOCUMENTS

| | | | |
|---|---|---|---|
| 535,595 | 3/1895 | Merz | 83/409.2 |
| 2,600,837 | 6/1952 | Boyer | 209/2 |
| 2,793,665 | 5/1957 | Pinard | 83/98 X |
| 3,277,755 | 10/1966 | Wray et al. | 83/98 X |
| 3,314,560 | 4/1967 | Bell | 414/412 |
| 3,382,874 | 5/1968 | Pinkham | 131/20 |
| 3,386,602 | 6/1968 | Kanarek | 414/412 |
| 3,534,526 | 10/1970 | Hostetler et al. | 53/282 |
| 3,552,095 | 1/1971 | Inman | 53/390 |
| 3,596,842 | 8/1971 | Barber | 241/222 |
| 3,682,341 | 8/1972 | Happel | 414/412 |
| 3,800,399 | 4/1974 | Warrick | 29/426 |
| 3,817,423 | 6/1974 | McKnight | 221/173 |
| 3,917,055 | 11/1975 | VandenBerg et al. | 198/278 |
| 3,939,998 | 2/1976 | Soltermann | 414/412 |
| 3,942,645 | 3/1976 | Aronson | 209/104 |
| 4,096,945 | 6/1978 | Melton, Jr. | 414/412 X |

*Primary Examiner*—James M. Meister

[57] ABSTRACT

A practice for recovering the contents of filled pharmaceutical capsules wherein the capsules are supported and a cutting blade cuts the supported capsules to allow egress of the capsule contents.

1 Claim, 3 Drawing Figures

METHOD FOR RECOVERING THE CONTENTS OF FILLED PHARMACEUTICAL CAPSULES

BACKGROUND OF THE INVENTION

This invention pertains to the recovery of pharmaceutical substances and, in particular, to the recovery of pharmaceutical substances carried in two component, hard gelatin capsules.

In the manufacture of encapsulated pharmaceuticals, a certain number of capsules are rejected for one reason or another during the manufacturing process. As the number of rejected capsules grows and the cost of the encapsulated pharmaceutical increases, it becomes increasingly important to recover the pharmaceutical product from the rejected capsules. In order for the recovery process to be acceptable, however, it must be carried out such that the physical integrity—bulk density, particle size, etc.—of the pharmaceutical product is not significantly altered.

Prior art procedures for the recovery of encapsulated pharmaceuticals have been mainly directed to the recovery of pharmaceutical product in powdered form. One practice presently employed is to subject the capsules to a milling procedure wherein the capsules are ground to produce a mixture of hard capsule fragments and powdered pharmaceutical. The mixture is then screened to separate the capsule fragments from the powdered pharmaceutical.

Another procedure which has been proposed for the recovery of pharmaceutical powder is disclosed in U.S. Pat. No. 3,800,399. In this procedure a pressure differential is created between the capsule interior and the surrounding area. This pressure differential causes separation of the capsule cap from the capsule body or rupturing of the capsule in cases wherein the cap and body are tightly fastened. Removal of the pharmaceutical powder is then carried out by blowing same through a screen which inhibits passage of the capsules.

In present day pharmaceuticals, it is often the case that the encapsulated product is in pellet or bead form, rather than in powdered form. Recovery of such pharmaceutical beads using the prior milling procedure is, however, undesirable, as the grinding action of this procedure is detrimental to bead integrity. Furthermore, present day capsules are usually provided with a strong locking mechanism. Use of the pressure differential procedure would thus require a high pressure to break this locking mechanism which again could be detrimental to bead integrity.

Additionally, it is usually the case that expensive filling equipment has been employed to fill the capsules. Use of further specialized milling or pressurizing equipment to recover the pharmaceutical product adds to this expense and, furthermore, reduces any gains achieved by the recovery.

It would thus be advantageous if a recovery procedure could be developed for both bead filled and powder filled capsules. It would be further advantageous if a procedure could be developed which could make use of some or all of the existing filling equipment.

It is therefore an object of the present invention to provide a method and apparatus for the recovery of encapsulated pharmaceutical product.

It is also an object of the present invention to provide a method and apparatus for the recovery of encapsulated pharmaceutical product which is adaptable to present capsule filling equipment.

It is further object of the present invention to provide a method and apparatus for the recovery of pharmaceutical beads in a manner which substantially preserves bead integrity.

SUMMARY OF THE INVENTION

The above and other objects are realized in accordance with the principles of the present invention in a practice wherein a capsule containing a pharmaceutical product is supported by a support means and wherein a cutting means is provided to cut the supported capsule so as to enable egress of the product from the capsule.

In the preferred embodiment of the invention to be disclosed hereinafter the support means comprises the spaced upper and lower capsule support members of a conventional capsule filling apparatus. These members have upper and lower bores, respectively, and are adapted such that these bores are maintained in alignment in moving from a capsule receiving station whereat a capsule is inserted from above into the upper bore, through a capsule cutting station whereat a cutting means is located which cuts the capsule body at a point accessible through the space between the upper and lower members. In this preferred embodiment a capsule ejection station immediately follows the cutting station and the support members are moved to maintain the bores in alignment into the ejection station whereat a jet of air is applied to the bottom of the lower bore causing the cut capsule parts to be expelled upwardly out of the bores.

BRIEF DESCRIPTION OF THE DRAWINGS

The above and other features and aspects of the present invention will become more apparent upon reading the following detailed descriptions in conjunction with the accompanying drawings, in which.

DETAILED DESCRIPTION OF THE INVENTION

Figure 1:
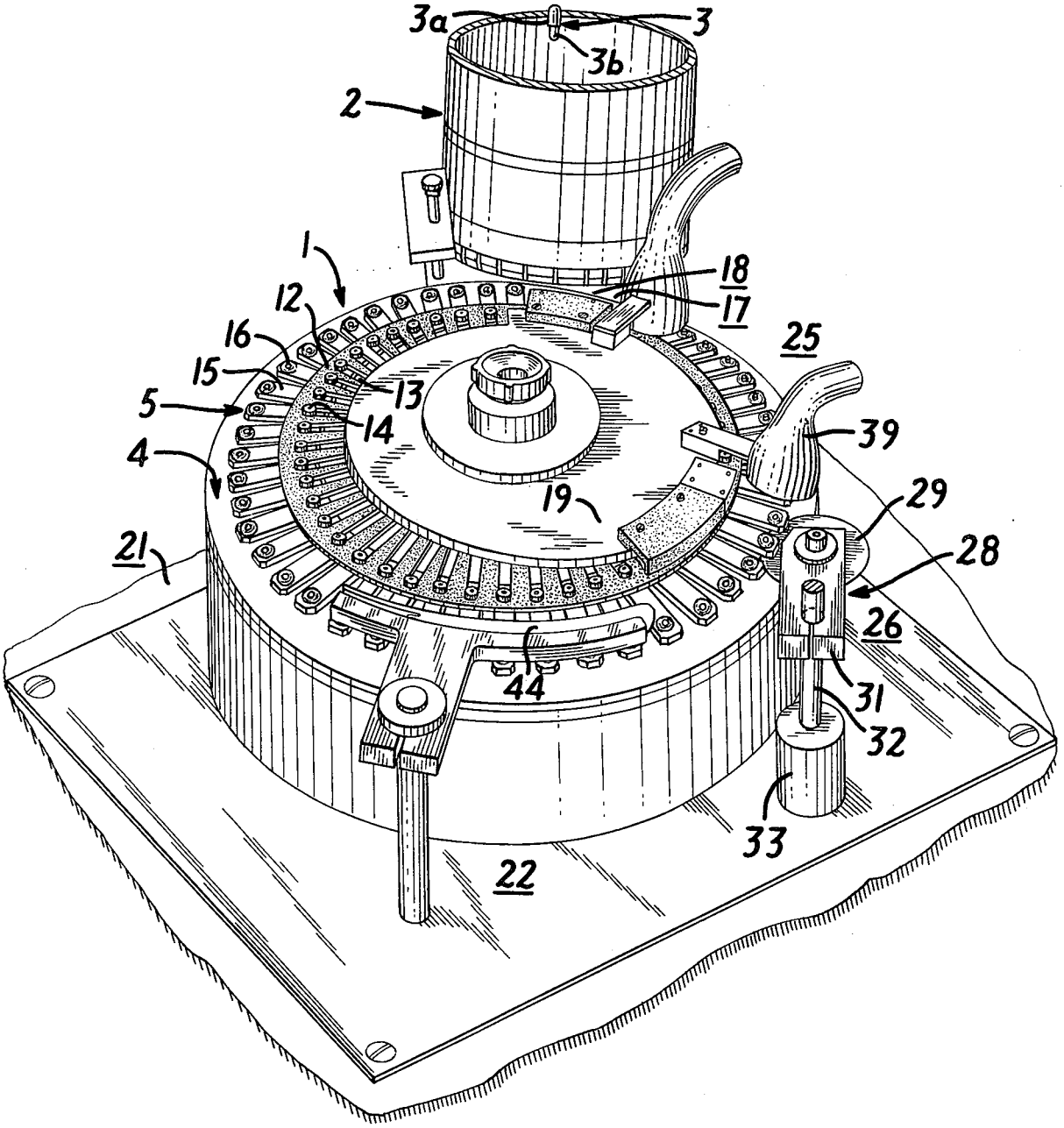
FIG. 1 shows a capsule cutting assembly in accordance with the principles of the present invention.

In FIG. 1, a capsule cutting apparatus or assembly 1 in accordance with the principles of the present invention is shown. The illustrated assembly has been realized by modifying a conventional capsule filling machine and, in particular, a capsule filling machine sold by Eli Lilly and Co. under the name Rotofil® Automatic Filling Machine Type P.

An orientating mechanism 2 receives pharmaceutical capsules 3 and provides at its output capsules oriented with their axes aligned in the vertical direction and with the caps 3*a* of the capsules upward. An orientating mechanism of this type, in addition, to being provided with the Rotofil® machine is also disclosed in U.S. Pat. No. 3,817,423.

Figure 2:
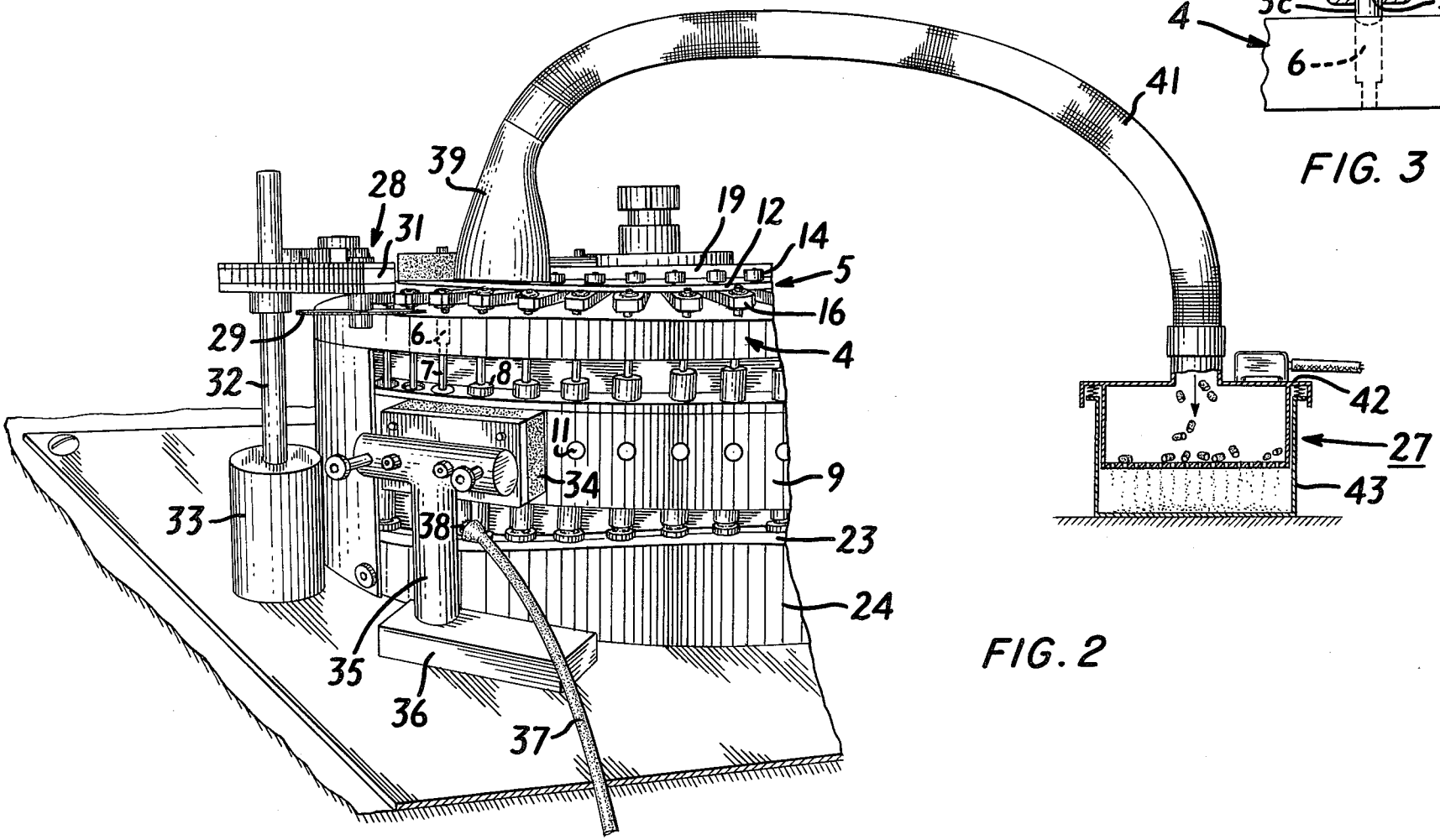
FIG. 2 shows in more detail the cutting and ejecting stations of the assembly of FIG. 1.

The oriented capsules are delivered from the orientating mechanism 2 to a capsule support mechanism comprising lower and upper spaced rotatably mounted support assemblies 4 and 5. The lower support assembly 4 is in the form of a ring and is provided with through bores 6 (See, FIG. 2) distributed around the ring periphery. These through bores are each adapted to slidably receive the tip end 7 of a hollow punch 8. The latter punches are slidably mounted in a bottom rotatably mounted ring 9. The side wall of ring 9 includes passages 11, each communicating with the interior of a different punch.

The upper support assembly 5 comprises an inner ring 12 provided about its periphery with radial slots 13. These slots provide guides for cam followers 14 of radially directed fingers 15. Fingers 15 (See, FIG. 3) include bushings 44 held by snap rings 45. Bushings 44 define through bores 16 for the fingers 15, which through bores at the outermost radial position of cam followers 14 align with respective through bores 6 in the ring 4.

In usual operation of the aforesaid assembly to fill capsules with pharmaceutical product and, in particular, beads or pellets, unfilled capsules 3 are first delivered to the hopper of the orienting mechanism 2. The mechanism 2 orients the capsules, as above described, and delivers each oriented capsule at delivery station 17 to a through bore 16 in a radial finger 15. Simultaneously with or immediately after such delivery at an immediately adjacent vacuum station 18, a vacuum is applied, via a vacuum block (not shown) adjacent the ring 9, to the radial bore 11 communicating with the bore 6 in the support 4 aligned with the capsule receiving bore 16. This vacuum causes the cap 3*a* and body 3*b* of the received capsule 3 to separate and the body becomes lodged in the bore 6 and the cap remains held in the bore 16, which is shaped in its interior to prevent through passage of the cap.

As the support rings 4 and 5 rotate, the cam follower 14 of the finger 15 is forced radially inwardly by a cam track of a cam (not shown) which is attached to the central fixed cam guide plate 19. Movement of the follower 14 inwardly causes like movement of the finger 15 so that the bore 16 holding the capsule cap 3*a* is now located radially inwardly of the bore 6 holding the capsule body 3*b*, thereby exposing the body. With this relative position of the bores maintained, the rings traverse a capsule filling station 21 at which is located a filling mechanism (not shown) wherein pharmaceutical product in pellet form is introduced into the capsule body 3*a* filling same.

Upon leaving the filling station 21, the cam track now urges the finger 15 radially outwardly to a point where the bore 16 carrying the capsule cap 3*a* now aligns with the bore 6 carrying the filled capsule body 3*b*. With this positioning maintained, the rings enter a capsule closing station 22 at which the punch tip 7 aligned with the through bore 6 carrying the filled capsule body 3*b* is urged upwardly by the punch body 8 as a result of the body riding upon a cam surface 23 of a lower fixed ring 24. Movement of the tip upwardly urges the capsule body 3*b* into the bore 16 and into locking engagement with the capsule cap 3*a*, this engagement being ensured by a closing plate (not shown) which is positioned at station 22 and acts to buttress the cap 3*a* against movement as the body is moved upwardly and locked thereto.

The rings 4, 5 and 9 then move from the closing station to an ejection station 25 whereat the cover plate terminates and the punch tip 7 continues to be urged upwardly by the cam surface 25. This brings the filled locked capsule upwardly out of the bore 16 at which time a jet of air is directed at the capsule blowing same into a discharge conduit.

The above explanation has described how the assembly 1 could be operated as a capsule filling assembly. In accordance with the principales of the present invention, however, the assembly 1 is adapted to recover pharmaceutical product and, in particular, pharmaceutical pellets, from already filled capsules. More particularly, the assembly 1 is modified as shown by removing the filling and closing station equipment and by removing the cam which moves the fingers 15 inwardly. The ejection station 25 is also modified and a capsule cutting station 26 is added. Additionally, a separating assembly 27, shown as separate from the basic assembly 1, is also added.

As shown, a cutting assembly 28 is located at cutting station 26 and comprises a flat circular cutting blade 29. The blade 29 is mounted from above by a mounting block 31 which is supported on a shaft 32 which extends upwardly from a weighted stand 33. The mounting is such that the cutting edge of the blade extends into the space between the fingers 15 and the upper surface of the support 4 and radially inwardly to a point beyond the peripheral location of the bores 6.

The ejection station 25 follows the cutting station 26 and comprises a block 34 communicating with the radial bores 11 in the ring 9. Block 34 is held by a T-shaped support 35 mounted on a stand 36. Compressed air is fed to block 34 via a conduct 37 attached to an inlet port 38 of the support 35.

A collection funnel 39 is situated above the bores 16 of the fingers 15 at the ejection station 25. A conduit 41 leads from the funnel 39 to the separating station 27 which includes a vibratory screening mechanism 42 supported on a collection receptacle 43.

Forward of the cutting station 26 is a pressure plate 44 supported slightly above the fingers 15. The fingers 15 are positioned by the guide plate 19 so that the bores 16 of the fingers are aligned with the bores 6 of the lower support and the removal of the cam ring from the guide plate ensures that this alignment is maintained through rotation of the rings 4 and 5 from the filling station 17 through the ejection station 25.

In operation, filled capsules are fed into the orienting mechanism 2 which again aligns the axes of the capsules vertically with the caps 3*a* upward. Each oriented capsule is delivered by the mechanism 2 to a bore 16 of a finger 15 at the delivery station 17, at which time the capsule is also subjected to a vacuum via the vacuum block at the vacuum station 18. This vacuum ensures proper seating of the filled capsule in the bore 16, but is insufficient to separate the cap 3*a* and body 3*b* of the capsule due to the strong locking engagement imparted to these parts during filling.

Figure 3:
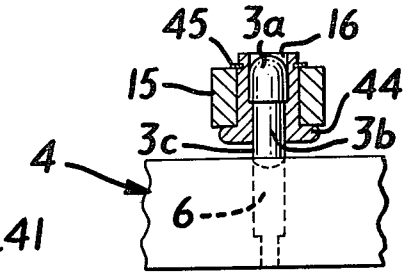
FIG. 3 illustrates a cross section through various elements of the assembly of FIG. 1.

As shown in FIG. 3, the body 3*b* of the capsule 3 in the bore 16 extends into the aligned bore 6 of the ring 4 with the body portion 3*c* between the lower surface of the finger 15 and the upper surface of ring 4 being situated in the space between these members. As the rings 4 and 5 rotate, the cap 3*a* of the capsule is engaged by the pressure plate 44 so as to right the capsule if the capsule is skewed.

As rotation continues, the capsule 3 is carried into the cutting station whereat the cutting blade 29 cuts through the circumferential area of the exposed capsule body portion 3*c*, thereby providing a means of egress for the pharmaceutical product. By suitable selection of the speed of rotation of the members 4 and 5 and the number of fingers 15 the cut capsule preferably remains in essentially the same position in bores 16 and 6 after cutting and upon arrival at the ejection station 25. At this station, compressed air passes from the block 34 into the bore 11 and from there through the punch and punch tip 7 to the lower end of bore 6. This air acts as a jet and shoots the cut capsule parts upwardly into the funnel 39 and carries them through conduit 41 to vibrating screen assembly 42.

The screen assembly 42 segregates the cut capsule parts from the pharmaceutical product by its vibratory action and the product passes through the screen of the assembly which inhibits passage of the larger capsule parts. The pharmaceutical product is then collected in receptacle 43 for reuse in filling empty capsules.

As presently illustrated, the blade 29 is situated to cut entirely through the capsules 3, but the blade could be adjusted so as to cut the capsule around less than its entire circumference. The degree of circumference cut must be such as to allow egress of the encapsulated product therethrough and will be dictated, amongst other things, by the product type (pellet, powder, etc.), product size, capsule resiliency and screening method. A preferable cutting range is from about 300 to 360° of the capsule circumference.

It also should be noted that the position at which the cut is made on the capsule body is preferably at or above the cupped shape end of the body. This again facilitates product egress.

As can be appreciated from the above, the present recovery assembly requires only relatively inexpensive and uncomplicated adaptation of existing capsule filling equipment. Furthermore, recovery is dependent upon simple cutting and pressure differentials and equipment for creating same are not needed. Finally, pharmaceutical product integrity is substantially ensured, particularly for product in pellet form.

In all cases, it is understood that the above-described arrangements are merely illustrative of the many possible specific embodiments which represent applications of the present invention. Numerous and varied other arrangements can readily be devised without departing from the spirit and scope of the invention.

What I claim is:

1. A method for recovering the contents of capsules containing pharmaceutical product comprising the steps of:

supporting a capsule in a support means with the axis of said capsule in the vertical direction;

cutting the supported capsule transverse to said axis to create an opening for egress of said pharmaceutical product;

ejecting said capsule from the support means after cutting;

said cutting of said capsule and said ejecting of said capsule occur at a cutting station and an ejecting station, respectively;

moving said support means to said cutting station whereat said cutting occurs and moving said support means to said ejecting station whereat said ejecting occurs;

and controlling said moving of said support means so that said capsule remains in the vertical direction and so that said capsule remains in essentially the same position in said support means when said support means is moved from said cutting to said ejecting station.

* * * * *